United States Patent [19]

Hatakeyama et al.

[11] 4,378,059

[45] Mar. 29, 1983

[54] ABNORMAL ELEVATOR SPEED DETECTOR

[75] Inventors: Takanobu Hatakeyama, Katsuta; Yasunori Katayama, Hitachi; Sadao Hokari, Katsuta; Kanji Yoneda, Katsuta; Tomiaki Kurihara, Katsuta; Toshio Meguro, Katsuta, all of Japan

[73] Assignee: Hitachi, Ltd., Tokyo, Japan

[21] Appl. No.: 255,103

[22] Filed: Apr. 17, 1981

[30] Foreign Application Priority Data

Apr. 18, 1980 [JP] Japan ..... 55-50479

[51] Int. Cl.[3] ..... B66B 5/06

[52] U.S. Cl. ..... 187/29 R

[58] Field of Search ..... 187/29

[56] References Cited

U.S. PATENT DOCUMENTS

| | | | |
|---|---|---|---|
| 3,972,389 | 8/1976 | Faup | 187/29 |
| 4,046,229 | 9/1977 | Kernick et al. | 187/29 |
| 4,128,141 | 12/1978 | Caputo et al. | 187/29 |
| 4,131,183 | 12/1978 | Krauer | 187/29 |
| 4,161,235 | 7/1979 | Caputo et al. | 187/29 |
| 4,161,236 | 7/1979 | Husson | 187/29 |

*Primary Examiner*—J. V. Truhe
*Assistant Examiner*—W. E. Duncanson, Jr.
*Attorney, Agent, or Firm*—Antonelli, Terry & Wands

[57] ABSTRACT

An abnormal speed detector for an elevator system having an elevator car for servicing a plurality of floors, means for driving the elevator car in response to a speed command and a speed detector for detecting a running speed of the elevator car is disclosed. The abnormal speed detector comprises means for storing a set of speed data indicating a predetermined abnormal speed checking pattern as a function of running time or running distance of the elevator car, means for reading out of the storage means one of the set of speed data corresponding to an instant value of the running time or running position of the elevator car after the start of run, and means for comparing an actual speed of the elevator car with the readout speed data to determine if the speed of the elevator car is normal or not.

8 Claims, 15 Drawing Figures

FIG. 5

| ADDRESS | DATA |
|---|---|
| ADDS | $D_0$ |
| ADDS + 1 | $D_1$ |
| ADDS + 2 | $D_2$ |
| ⋮ | ⋮ |
| ADDS + n | $D_n$ |
| ⋮ | ⋮ |
| ADDS + N | $D_N$ |
| ADDS + N + 1 | $D_\Delta$ |

FIG. 6

| ADDRESS | DATA |
|---|---|
| $A_1$ | READ-OUT ADDRESS OF ROM FOR ABNORMAL SPEED CHECKING DATA |
| $A_2$ | CONTENT OF PTM T PERIOD EARLIER |
| $A_3$ | RUN DISTANCE (SPEED) OF ELEVATOR IN T PERIOD |

ABNORMAL ELEVATOR SPEED DETECTOR

The present invention relates to an abnormal elevator speed detector, and more particularly to an elevator speed detector which rapidly detects abnormal speed of an elevator to assure safe running of the elevator.

If an elevator controller fails by some cause, the speed of the elevator may abnormally increase or decrease depending on the nature of the cause to bring about a dangerous condition. Therefore, such an abnormal operation must be rapidly detected to assure safe running of the elevator.

One of the prior approaches to the above problem is described below with respect to an A.C. elevator driven by a three-phase induction motor. The speed control of the A.C. elevator is effected by a driving torque control unit having inverse-parallel connected thyristor circuits inserted in two or three phases of the primary winding to control the primary voltage of the induction motor by controlling the conduction phase angle of the thyristors for controlling the driving torque, and a braking torque control unit which supplies a D.C. output of a rectifying thyristor circuit to the induction motor for controlling the D.C. braking torque applied thereto by controlling the conductor phase angle of the thyristors. The driving force or the braking force of the induction motor is feedback-controlled in accordance with the difference between an actual speed and a reference speed command over an entire running range from the start of the elevator to the stop of the elevator at a target floor. In such a control system, if the thyristors of the driving and/or braking torque control units fail, the elevator may undergo the following abnormal operation.

For example, when the elevator is running upward and the load of its cage is small, or when the elevator is running downward and the load of the cage is large, and if the thyristors of the driving torque control unit become nonconductive thereby failing to apply the normal voltage to the motor, the elevator speed is gradually increased by an unbalanced torque determined by the difference between the weight of the cage and the weight of a counterweight thereof. Even if the speed exceeds the synchronous speed of the motor, no regenerative braking force is developed because no normal voltage is applied to the motor and hence the elevator speed increases up to a dangerous speed beyond the rated speed thereof.

If the failure is such that the thyristors in the braking torque control unit are fixed at the conducting state, that is, gate control is disabled so that the thyristors operate in a diode mode, an excess D.C. current flows through the motor causing a large braking force to be developed. As a result, the elevator is rapidly decelerated presenting abnormal shock to passengers of the elevator.

In addition, if the thyristors or the control devices for the thyristors of the driving torque control unit and the braking torque control unit fail simultaneously, the elevator undergoes similar abnormal operations.

One of the methods for detecting the abnormal operation or failure is as follows.

For the failure in which the normal voltage is not applied to the elevator and the elevator speed increases, the current flowing in the motor is monitored and if the current is detected as zero, the power supply is immediately turned off and the electromagnetic brake is actuated to stop the elevator.

However, since the driving torque and the braking torque are alternately applied for continuously controlling the speed over the entire running range, there necessarily exists a time period in which the current is zero at a switching point of the torques. Accordingly, the detection of the failure by such zero current method is ineffective during the torque switching period. Thus, if the failure occurs during that period, the failure cannot be detected.

For the failure in which the thyristors of the braking torque control unit fail and the elevator is rapidly decelerated, the braking current is monitored and if it exceeds an upper limit of the normal braking current range, an abnormal condition is determined and the power supply is turned off and the electromagnetic brake is actuated to stop the elevator. Since the torque of the electromagnetic brake is much smaller than the D.C. braking torque which would otherwise occur at failure, the shock presented to the passengers when the elevator is stopped by the electromagnetic brake actuated upon detection of the failure is smaller than that when the elevator is stopped by the D.C. braking torque.

However, in such a braking current detection method, due to the variances of the torque characteristic of the motor and the detection characteristic of the current detector, the reference level for detecting the abnormal braking current must be set to a much higher level than the maximum current level in its normal operation condition. As a result, even if the failure occurs and the braking current increases, the detector does not detect the abnormal condition until the current reaches the set level. Accordingly, a satisfactory detection is not attained.

Thus, the above-mentioned detection methods cannot satisfactorily detect the abnormal operation of the elevator when the control elements of either the driving torque control unit or the braking torque control unit fail.

It is an object of the present invention to eliminate the difficulties encountered in the prior art systems and provide an abnormal elevator speed detector which immediately detects the abnormal operation of the elevator caused by the failure of the driving torque and/or braking torque control units to prevent abnormal increase or decrease of the elevator speed.

In accordance with the present invention, the abnormal elevator speed is detected by repeatedly comparing an actual speed of the elevator with an abnormal speed checking pattern during the elevator running for checking if the actual speed is normal or not to detect the abnormal speed when a difference therebetween exceeds a predetermined value.

The above and other objects, features and advantages of the present invention will be understood from the following detailed description of the preferred embodiments of the invention taken in conjunction with the accompanying drawings, in which;

FIG. 1 is a block diagram showing an arrangement of a typical example of an elevator controller to which the present invention is applicable, FIGS. 2A and 2B show two forms of elevator speed command pattern, FIG. 3 is a block diagram showing a schematic configuration of a microcomputer used in the present invention, FIGS. 4A and 4B show diagrams illustrating relationships between an elevator speed and an abnormal speed check pattern and an speed command in accordance with one embodiment of the present invention.

FIGS. 5 and 6 show examples of memory maps of a ROM and a RAM, respectively,

FIGS. 7 and 8 show flow charts of processes carried out by the computer to detect the abnormal speed in the embodiments associated with FIGS. 4A and 4B, FIGS. 9A and 9B show diagrams illustrating other relationships between the elevator speed and the abnormal speed check pattern and the speed command in another embodiment of the present invention, FIGS. 10A and 10B show diagrams illustrating relationships between the elevator speed and the speed command in a further embodiment of the present invention, and FIG. 11 shows a flow chart of a process carried out by the computer for detecting the abnormal speed in an embodiment associated with FIGS. 10A and 10B.

Referring to FIG. 1, a cage 1 of an elevator is carried by a sheave 4 through a rope 3 with a counterweight 2 attached to the other end of the rope 3. The sheave 4 is coupled through a reduction gear 5 to an elevator driving three-phase induction motor 6 and an electromagnetic brake 7. Coupled to the induction motor 6 is a three-phase A.C. tachometer generator 8. Since the output voltage and frequency of the A.C. tachometer generator 8 are proportional to the rotation speed of the motor 6, the output is converted to a pulse train by a waveform reshaper 13, which pulse train is used to detect the position of the elevator in a manner described later. The output of the tachometer generator 8 is also rectified to produce a D.C. signal which is proportional to the velocity of the elevator. This D.C. signal is compared with a reference speed command to be described later to control the driving force and the braking force of the motor 6 in accordance with a difference therebetween.

Terminals R, T and S are connected to denote feeder lines of a three-phase A.C. power supply. A main contact circuit 17 is controlled by an elevator controller 19 to change line connection for selecting the elevator running mode such as upward running, downward running, maintenance running or normal running and connected to a thyristor controller 16 which includes a driving torque control unit 16D and a braking torque controlling unit 16B arranged of thyristors or a combination of thyristors and diodes. As is known the driving torque control unit 16D controls the driving torque imparted to the motor 6 by phase controlling the thyristors connected to respective phases of the three-phase supply, and the braking torque control unit 16B is connected to two of the three phase and controls the D.C. braking force imparted to the motor 6 by phase-control of the thyristor. A phase controller 15 controls the elevator speed in speed feed-back mode by controlling the firing phase of the thyristors of the thyristor controller 16 in accordance with a reference speed command from a digital computer such as a microcomputer 14 shown in FIG. 3 and a signal indicative of the elevator speed from the tachometer generator 8. Through this feedback control, the cage 1 of the elevator is driven at a speed following a speed command 18 generated from the microcomputer 14.

The speed command 18 has a pattern which rises as a function of time lapsed after starting of the elevator an during acceleration period and falls as a function of position or a run distance from the deceleration initiating point during a deceleration period. It is generated by the microcomputer 14 based on a position signal from a waveform reshaper 12 and other signals from the tachometer generator 8, an elevator controller and an internal clock.

More particularly, the speed command 18 is issued by sequentially reading out a corresponding one of speed command data which are predetermined according to a predetermined preferred speed pattern ranging from the start to the stop of the elevator and stored in a read-only memory (ROM) 26 of the microcomputer 14, in response to timer interruption signals each generated at every predetermined time interval after the start of the elevator or position interruption signals each generated at every predetermined distance of run of the elevator after initiation of deceleration. This will be more fully explained later. The timer interruption signal is generated every time when a predetermined number of clock pulses generated by a internal clock 21 of the microcomputer 14 have been counted from starting of the elevator. The position interruption signal is generated every time when a predetermined number of pulses generated by the tachometer generator 8 have been counted from initiation of the deceleration of the elevator. The starting time of the elevator and the position where the elevator initiates deceleration are determined by the microcomputer 14 or any other known means in accordance with various operational parameters of the elevator such as car call, hall call and running position of the elevator to be described later. This is disclosed in, for example, U.S. Pat. No. 3,750,850 issued Aug. 7, 1973 and entitled "Floor Selector for an Elevator car" and hence details thereof are not explained here. A speed command in acceleration run and constant speed run, that is, an acceleration command is generated based on the data obtained by the timer interruption, and a speed command in a deceleration run, that is, a deceleration command is generated based on the data obtained by the position interruption. The speed command has a stepwise increasing and decreasing pattern as shown in FIG. 2A and it is used as a base for generating an abnormal speed check pattern. It is converted to an analog quantity by a D/A converter and smoothened by a filter circuit to produce a speed command as shown in FIG. 2B which is used to control the firing phase angle of the thyristors of the thyristor controller 16 by the phase controller 15.

In order to detect the position of the elevator, position detectors 10 and 11 are mounted on the cage 1 of the elevator so as to produce signals, respectively, when they pass across one of the shield plates which are provided, respectively, at a specific point in the path of the run of the elevator, e.g. at a points corresponding to the highest floor or the lowest floor and at stop points or floor landing points of the elevator at respective floors. In FIG. 1, one of the shield plates mounted at the floor landing points at the respective floors is shown by reference numeral 9. A position determined by signals derived from the position detectors 10 and 11 when passing across the shield plate mounted at the specific point, i.e. the highest floor or the lowest floor is used as a reference position, and the run position of the elevator is detected by the number of pulses generated by the tachometer generator 8 indicative of the run distance from the reference position. The floor landing position of the elevator is detected by the signals derived from the position detectors when passing across one of the shield plates mounted at the respective floors. The position detections are carried out by the microcomputer 14 in response to the signals from the position detectors 10 and 11 received through the waveform reshaper 12 in the same manner as described in detail in a copending U.S. patent application Ser. No. 208,579 filed on Nov. 20, 1980 assigned to the same assignee of the present application and entitled "Method and Apparatus for Detecting Elevator Car Position".

The microcomputer 14, as shown by a broken line block in FIG. 3, includes a microprocessor unit (MPU) 20, an internal clock 21 for timing the operation of the MPU 20, a speed checking timer 33 for applying a timing signal every predetermined time interval to the MPU 20 to establish a timing of checking of abnormal speed of the elevator, a programmable counter timer element (PTM) 22 which receives output pulses from the A.C. tachometer generator 8 through the waveform reshaper 13 thereby to decrease the content of the counter by one each time when one pulse is received or to change the content of the counter, when a pulse is received after the content has reached zero, to a maximum value, e.g. FFFF in hexadecimal notation if the counter is a 16-bit counter and the content of which counter can be preset to any desired count and read out by the MPU 20, peripheral interfaces (PIA) 23, 24 and 25 for communicating external digital signals with the microcomputer 14, a read-only memory (ROM) 26 which stores an operating program of the MPU 20, a random access memory (RAM) 27 used as a temporary store serving as a working area for the MPU 20, a data bus 28 through which data is exchanged between the above-mentioned elements, and a control bus 29 through which various control signals such as address signals for the memory, selection signals for the elements, clocks and interruption signals are transferred.

The position signal from the position detectors 10 and 11 is applied to the PIA 23 through the waveform reshaper 12. The speed command 18 is generated by the microcomputer 14 and applied to the phase controller 15 through the D/A converter 30 which converts the digital speed command signal output from the PIA 24 to an analog signal and the filter circuit 31. Input signals from a control panel operated by an operator of the elevator and the elevator controller 19 (FIG. 1) are applied to the PIA 25 through an I/O device 32.

By the construction described above, an actual speed of the elevator is compared with the abnormal speed checking data stored in the ROM 26 of the microcomputer 14 to determine if the elevator speed is normal or not.

FIG. 4A shows a relationship between the elevator speed and the abnormal speed checking pattern, in which a curve (a) depicts a reference speed of the elevator, (b) shows an upper limit of the abnormal speed checking pattern and (c) shows a lower limit thereof. When the elevator runs at a speed between (b) and (c), a normal condition is determined, and when the elevator runs at a speed higher than the limit (b) or lower than the limit (c), an abnormal condition is determined.

An interruption is requested to the microcomputer 14 by the speed checking timer 33 at every fixed time interval over the entire running range of the elevator from the start to the stop to detect the actual speed of the elevator and the detected actual speed is compared with the data stored in the ROM 26 which correspond to the limits (b) and (c) shown in FIG. 4A for checking if the elevator speed is normal or not.

The abnormal speed check data is prepared by dividing the speed range from the maximum speed of the upper limit curve (b) shown in FIG. 4A to zero into a number of different levels corresponding to the number of steps of the speed command to be given in the deceleration mode of FIG. 2A. The resulting data $D_o - D_N$ is stored in addresses ADDS−ADDS+N of the memory map in the ROM 26 shown in FIG. 5. The data $D_o - D_N$ are upper limits of the abnormal speed check data and $D_o$ is the maximum value of the data.

The lower limits of the abnormal speed check data may be stored in other addresses in a similar manner, but in order to reduce the required memory capacity data $D_\Delta$ corresponding to a difference $\Delta V$ between the upper limit (b) and the lower limit (c) shown in FIG. 4A is stored at an address ADDS+N+1 shown in FIG. 5 and the lower limit data is generated by subtracting $D_\Delta$ from the upper limit data when the lower limit speed is to be checked.

During the acceleration mode of the elevator (period Ta in FIG. 4A), data $D_o$ of the speed checking data is read out for checking only the upper limit of the speed. While after the period Ta, the upper limit and the lower limit are checked and hence it is required to read out the upper limit data and to obtain the lower limit data in the manner described above to be compared with the actual speed.

After the elevator has begun deceleration, the abnormal speed check data $D_o$, $D_1$, $D_2$, . . . , $D_n$ is to be read out in this order. The address at which the data to be read out next is stored is temporarily stored at an address $A_1$ of the RAM shown in FIG. 6 in response to a position interruption signal generated at every predetermined run distance of the elevator. When the speed checking timer interruption request is issued, the content at the address $A_1$, that is, the current speed checking data is read out, which is then compared with the actual speed of the elevator. The timer interruption for executing the speed check is issued periodically at a frequency which is higher than, for example, three times of the frequency at which the position interruption for updating the content of the address $A_1$, i.e. the read-out address for the current speed checking data is periodically issued.

FIG. 7 shows a flow-chart of a program stored in the ROM 26 for implementing the above steps.

The program is prepared to execute an initialization step 100 for resetting, when the power supply is turned on, flags and variables of the microcomputer 14 and resetting the PIAs 23, 24 and 25, the PTM 22 and the PAM 27, a step 200 for stopping the elevator when it reaches the floor landing position, a step 300 for starting the run of the elevator, steps 400 and 500 for determining whether or not there occurs a request for the speed checking timer interruption or the position interruption for updating the readout address for the speed checking data, a step 600 which is executed, when the position interruption is issued, for updating the content of the address $A_1$ in RAM, i.e. the read-out address for the current abnormal speed checking data, a step 700 which is executed, when the timer interruption is issued, for detecting the actual speed of the elevator, a step 800 for comparing the actual speed of the elevator with the abnormal speed check data to determine if the elevator speed is normal or not, a step 900 for stopping the elevator upon detection of the abnormal speed, and a step 1000 for checking, upon detection of the normal speed, if the elevator has reached the floor landing position and jumping to the stop step 200 if it has reached or to the step 400 thereby waiting for the next interruption if it has not reached.

In the step 200 for stopping the elevator, the register and the flags used for running the elevator when the elevator was stopped at the floor landing position are reset to prepare for the next operation.

In the step 300 for starting the run of the elevator which is carried out when the microcomputer 14 generates a start of run signal on the basis of various signals related to the run of the elevator, a maximum value FFFF is set to the counter of the PTM 22 and the first address ADDS where the first one of the speed checking data is stored in the ROM 26 is stored at the address $A_1$ of the RAM shown in FIG. 6.

In the step 600 for updating the read-out address for the abnormal speed checking data, the addresses ADDS, ADDS+1, . . . ADDS+N at which the abnormal speed checking data is stored, respectively, as shown in FIG. 5 are sequentially stored in that order in the address $A_1$ of the RAM shown in FIG. 6 each time when the position interruption signal is generated.

In the step 700 for detecting the actual speed of the elevator, the difference between the content of the address $A_2$ in the RAM of FIG. 6, i.e. the past content of the counter of the PTM 22 at a T period earlier in time, where T is a period in the periodic occurrence of the interruption signal from the timer 33, and the current content of the counter of the PTM 22 is calculated and the difference is stored at the address $A_3$ of the RAM while the current content of the counter of the PTM 22 is stored at the address $A_2$ in place of the past content.

The difference between the current content of the counter of the PTM 22 and the past content thereof represents the run distance of the elevator in the time period T. It, therefore, has a velocity dimension and it is used as the actual speed of the elevator.

It should be understood that the abnormal speed checking data of FIG. 5 must have the same dimension as that of the speed detected in the manner described above.

FIG. 8 shows the subroutine of the step 800 for comparing the elevator speed with the abnormal speed checking data to determine if the elevator speed is normal or not.

Referring to FIG. 8, a step 801 determines if a time period Ta has elapsed since the start of the elevator and if it has not elapsed the process goes to a step 803 in which the content of the ROM addressed by the content at the address $A_1$ of the RAM of FIG. 6, that is, the data $D_o$ stored at the address ADDS in FIG. 5 is read out.

The data $D_o$ is used to check the upper limit of the elevator speed and it corresponds to the maximum value of the upper limit (b) shown in FIG. 4A. The data $D_o$ is set to any desired value between the rated speed of the elevator and a speed at which a speed governor for mechanically detecting the upper limit of the abnormal speed of the elevator is actuated.

In the next step 804, the actual speed $D_V$ of the elevator currently stored in the RAM, that is, the content of the address $A_3$ of FIG. 6 is read out. Then the actual speed $D_V$ is compared with $D_o$ in a step 805. If the elevator speed $D_V$ is not less than the upper limit $D_o$ of the abnormal speed checking data, the elevator is immediately stopped in a step 900.

If the elevator speed is not abnormal, i.e. the elevator speed $D_V$ is less than the upper limit $D_o$, the process goes to the step 1000.

If the step 801 determines that the time period Ta has elapsed since the start of the run of the elevator, the upper limit of the elevator speed as well as the lower limit thereof are checked.

In a step 806, the content of the ROM addressed by the content of the address $A_1$ of the RAM shown in FIG. 6, for example, the content of ADDS+n in the ROM, i.e. the abnormal speed check data Dn is read out. In a step 808, the check data Dn is compared with the elevator speed $D_V$ read out in a step 807 to check if the elevator speed is lower than the upper limit of the abnormal speed checking data.

If the elevator speed is not lower than the upper limit of the abnormal speed checking pattern, the elevator is stopped. If it is lower than the upper limit, the lower limit of the speed is checked in the next step.

In the step 809, the difference data $D_{66}$ stored in the address ADDS+N+1 of the ROM 26 shown in FIG. 5 is subtracted from the upper limit $D_n$ of the abnormal speed checking pattern previously read out to generate the lower limit $D_U = D_n - D_\Delta$ of the abnormal speed checking pattern. In a step 810, the lower limit $D_U$ is compared with the elevator speed $D_V$ and if the elevator speed $D_V$ is not higher than $D_U$, the power supply is immediately turned off and the electromagnetic brake is actuated to stop the elevator (step 900). If $D_V > D_U$, it is determined that the elevator speed is normal and the process goes to a step 1000 (FIG. 7) in which it is determined if the elevator has reached the floor landing position. If it has reached that position, the process returns to the step 200, and if it has not reached that position, the process enters a loop for waiting for the next timer interruption and when the next timer interruption is issued the elevator speed check is again carried out in the same manner as described above.

In the illustrated embodiment, only the upper limit of the speed is checked during the predetermined time period Ta after the start of the elevator. If it is necessary to check not only the upper limit but also the lower limit over the entire running range, the following process is carried out. As shown in FIG. 9A, an upper limit speed checking pattern (b) is determined to be $\Delta V_o$ larger than a reference elevator speed pattern (a) and a lower limit speed checking pattern (c) is determined to be $\Delta V_U$ smaller than the reference elevator speed pattern (a). The upper and lower limit speed checking data are obtained on the basis of the upper and lower limit speed checking patterns and stored in predetermined addresses of the ROM.

During the acceleration period, the readout address for the data is successively renewed at every constant time interval or in synchronism with the timing of updating of the acceleration command, and during the deceleration period the readout address for the data is successively renewed at every predetermined run distance of the elevator after the deceleration has started or in synchronism with the timing of updating of the deceleration command. That data is compared with the actual speed of the elevator to check the elevator speed.

Thus, in the present embodiment, the data used to check if the elevator speed is normal or not is stored in the ROM and they are compared with the actual speed of the elevator to check the upper and lower limits of the elevator speed. Accordingly, when the torque controller of the elevator fails, it is rapidly detected so that the electromagnetic brake is actuated to stop the elevator. As a result, a highly safe elevator controller is provided.

If the abnormal speed check data is set very closely to the actual speed of the elevator, the actually normal elevator speed might be detected as being abnormal because the actual elevator speed would vary more or less due to variances of the elevator controller or the motor characteristic or variance of the characteristic of the deceleration initiating position detector. Accordingly, the abnormal speed checking data must be set to a value with a reasonable margin.

However, if the abnormal speed checking data is set to a value with too much margin, the detection of abnormal condition is necessarily delayed. Therefore, if such an abnormal condition takes place near the deceleration initiating position for the terminal floor such as the uppermost floor or the lowermost floor, the elevator may overrun beyond the uppermost floor or the lowermost floor to collide against a safety mechanical buffer so that the elevator is no longer operative to restart towards the normal running zone.

Accordingly, in addition to the process described above, the following process may be adopted for the uppermost or lowermost floor in order to stop the elevator within a predetermined safe zone.

To this end, the electromagnetic brake is actuated to stop the elevator if the elevator speed has not been decelerated to a predetermined level when the elevator has reached a predetermined position before the terminal floor. The predetermined position is selected to such a position that when the electromagnetic brake is actuated at that position it is sure that the elevator is stopped in the safe zone where the elevator is operative to restart towards the door open zone.

FIG. 10A shows an elevator speed curve and FIG. 10B shows a corresponding speed command. A point P represents the deceleration initiating position, a point R represents a stop position in a normal condition and a point Q represents the check position where the speed check is carried out to determine if the elevator speed is normal or not.

The microcomputer determines a past maximum speed $V_M$ which is stored in the RAM. When the elevator reaches the point Q, the actual speed $V_l$ of the elevator at that point is compared with the previously detected maximum speed $M_M$, and when the difference therebetween is smaller than a predetermined value, an abnormal condition is determined and the electromagnetic brake is actuated.

Figure 1:
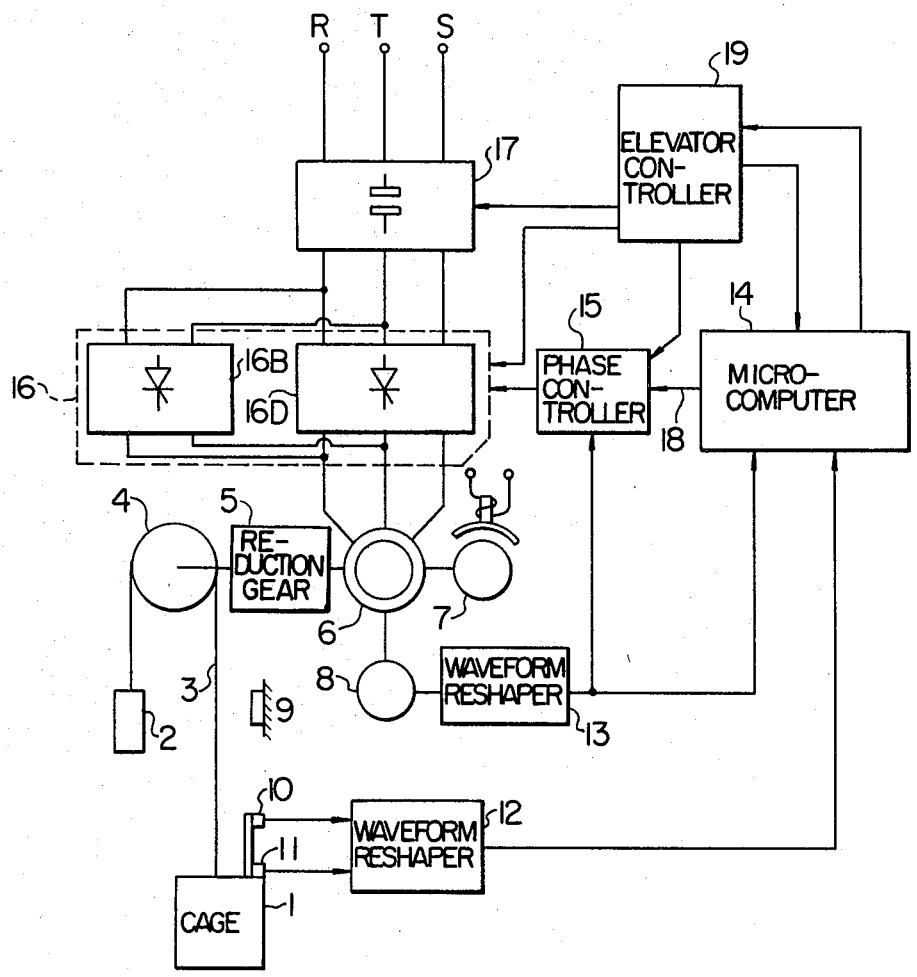
Figure 2A:
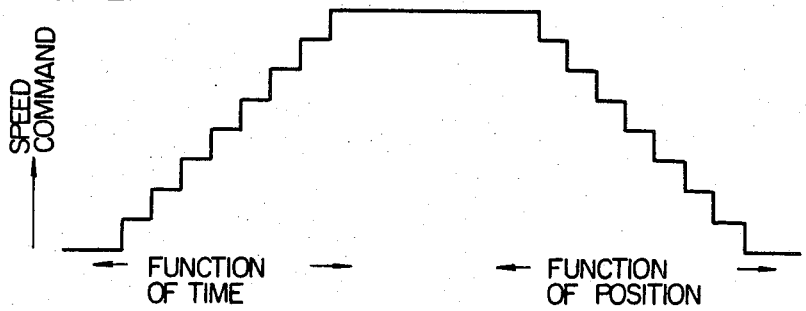
Figure 2B:
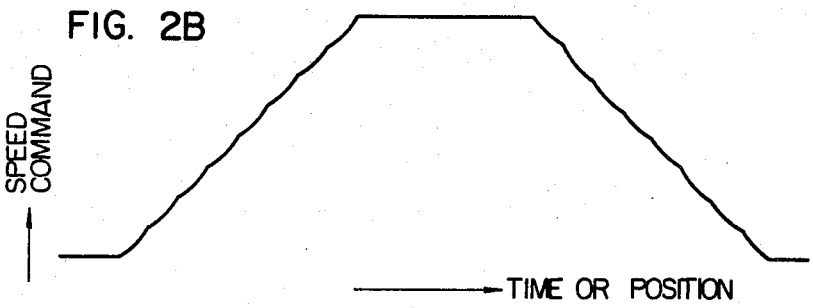
Figure 4A:
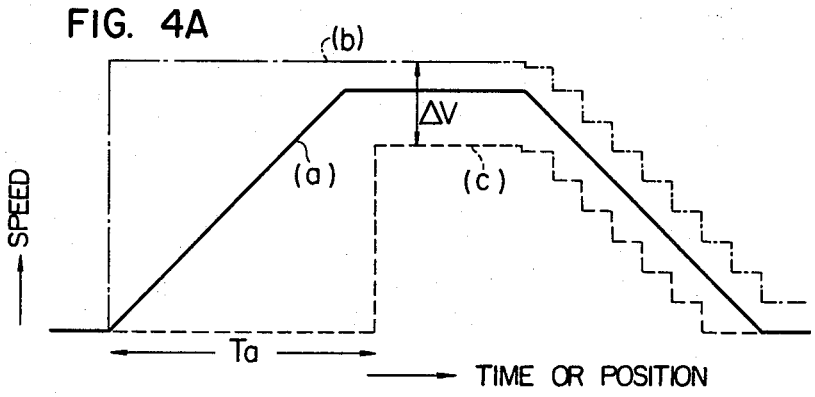
Figure 4B:
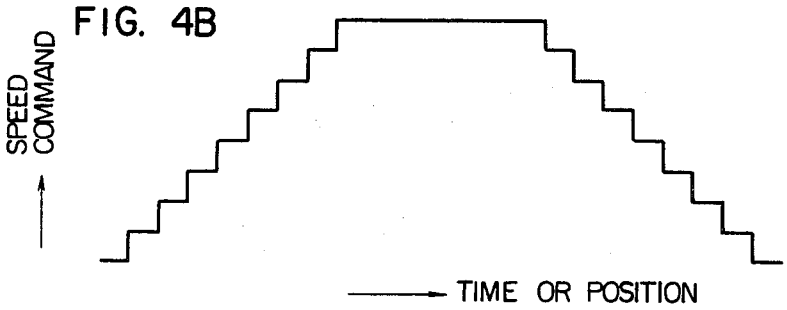
Figure 3:
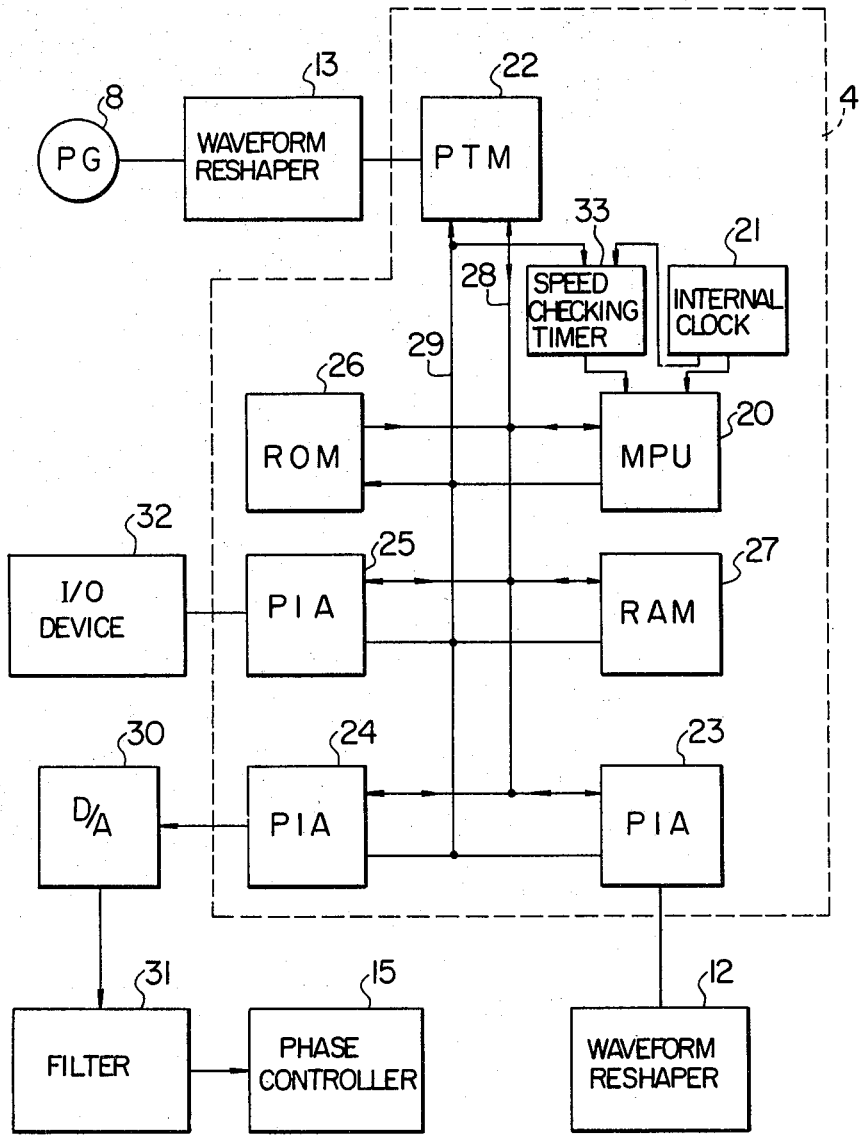
Figure 7:
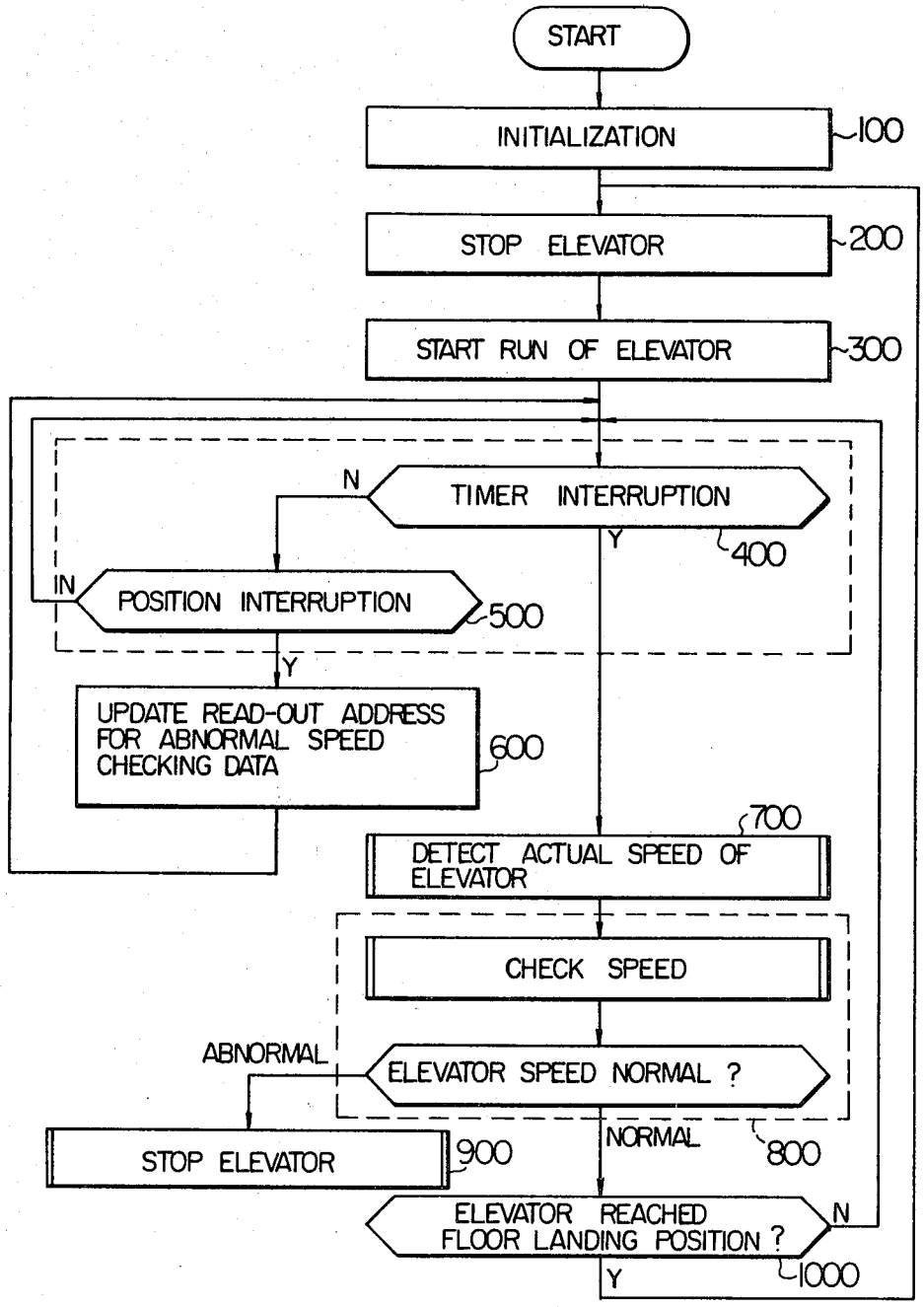
Figure 8:
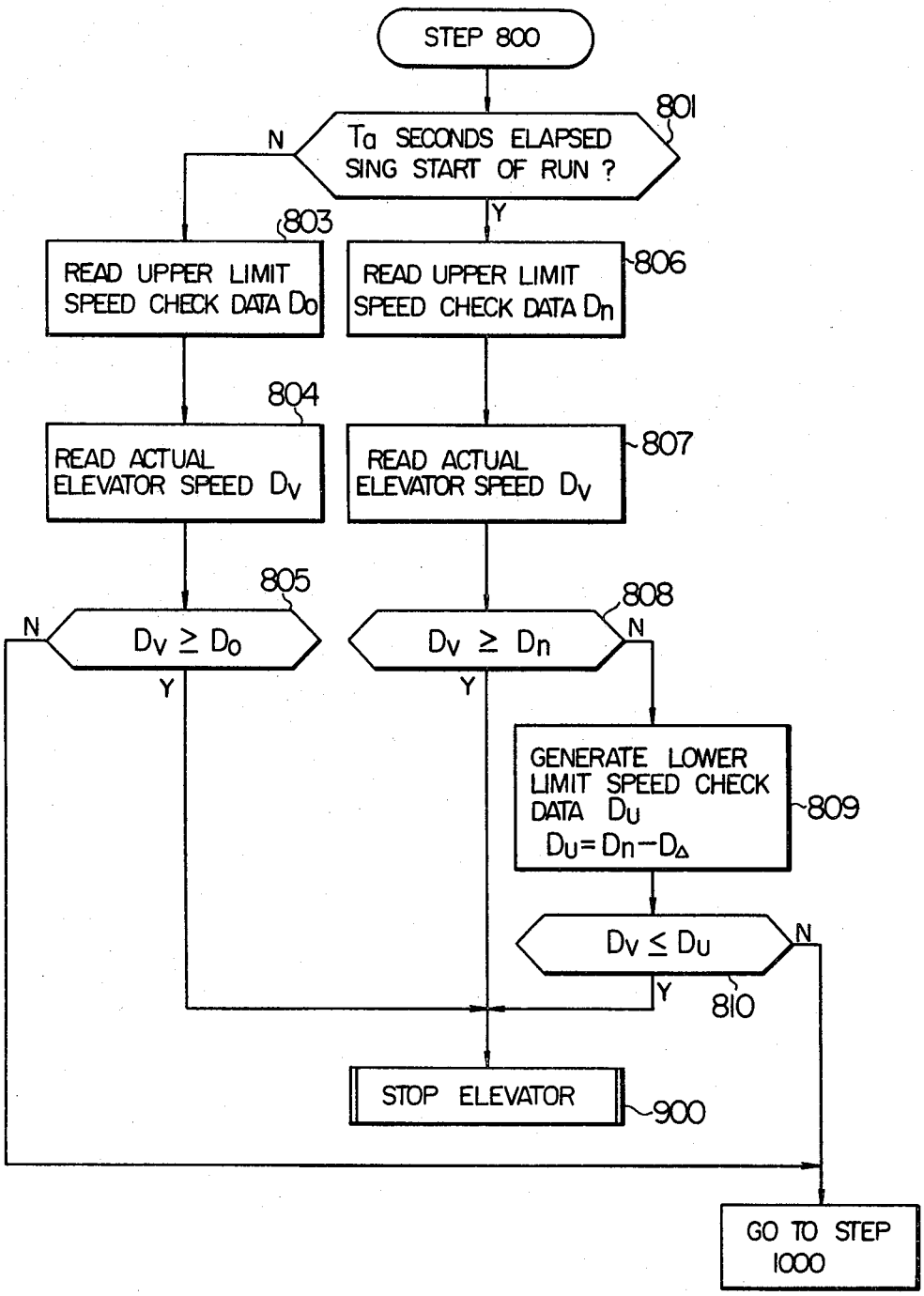
Figure 9A:
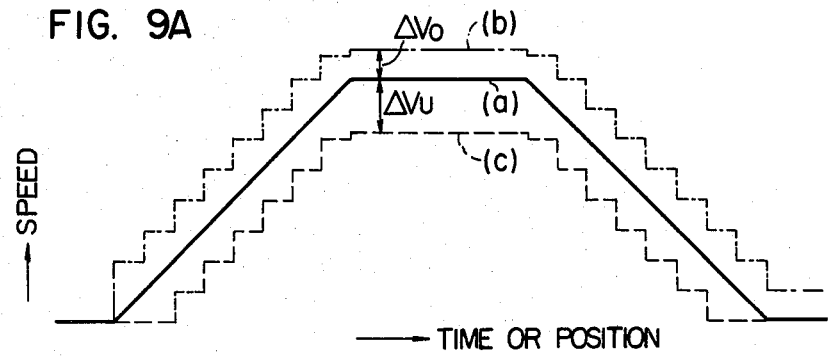
Figure 9B:
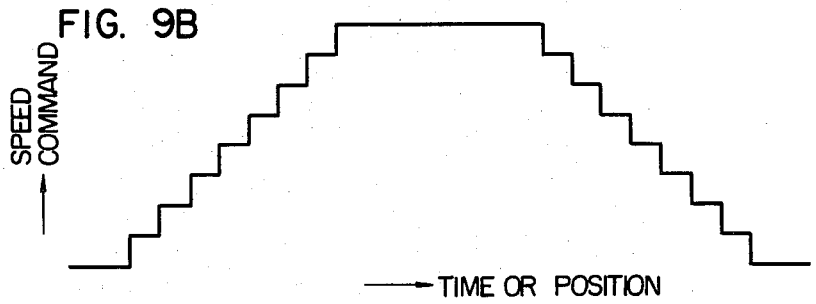

The maximum speed of the elevator is determined by comparing the past speed at a time period T earlier with the current speed determined in the step 700 in FIG. 7 and if the difference therebetween is substantially zero the current speed is regarded as the maximum speed $D_M$ (corresponding to $V_M$) and it is stored in the RAM 27.

Since the speed at the point Q in the normal condition must have been reduced to a certain level lower than the maximum speed determined above, an allowable minimum speed drop $D_\alpha$ which should be reduced in any event during the deceleration run from the deceleration initiating point P to the check point Q in the normal condition is predetermined and stored in the ROM 26.

Figure 11:
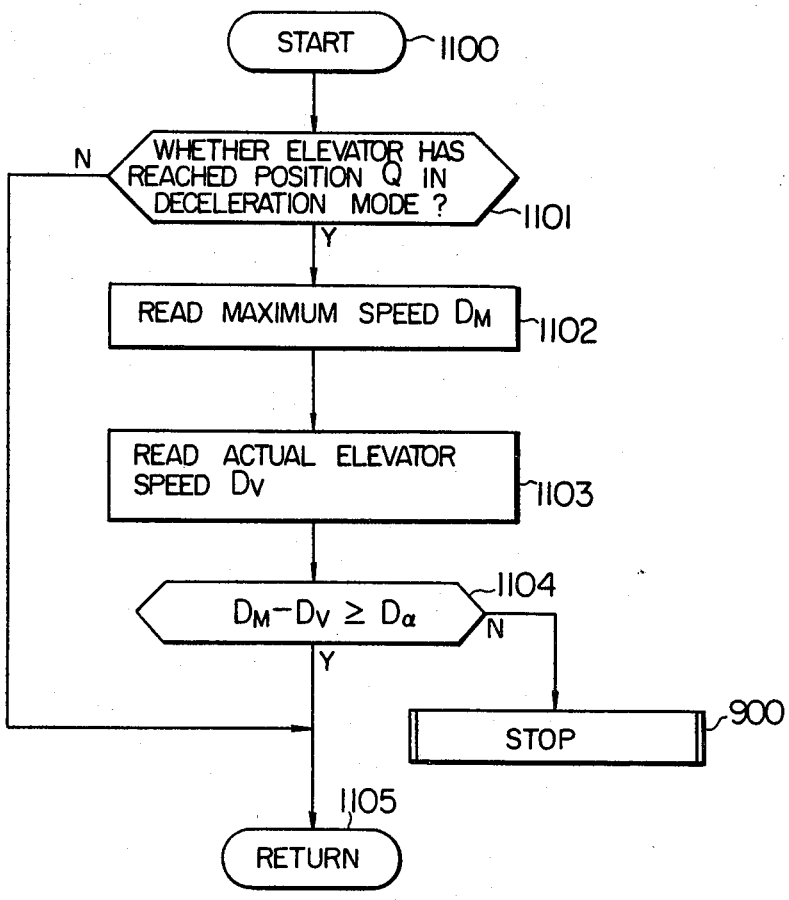

In a step 1101 of FIG. 11, it is determined if the elevator has reached the point Q in the deceleration mode. This is carried out by checking the updated content of the address $A_1$ of the RAM in FIG. 6 and when the updated content represents the address of the ROM where the speed check data to be used at the point Q is stored, it is determined that the elevator has reached the point Q.

Figure 10A:
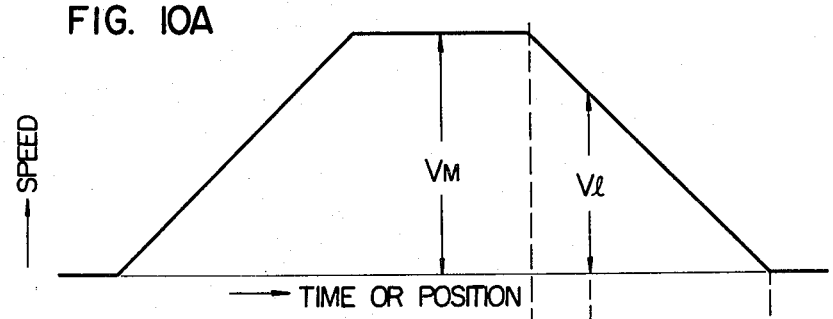
FIGS. 10A and 10B show such a position in the speed and speed command patterns which are substantially the same as those previously described and FIG. 11 shows a flow chart of the process for checking the elevator speed at the position Q.
Figure 10B:
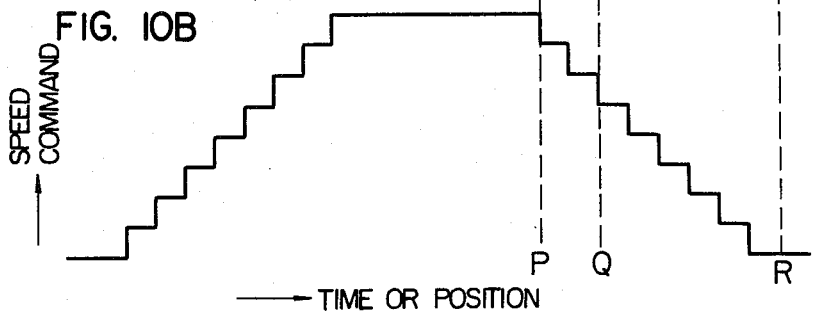

The maximum speed data $D_M$ previously detected in the manner described above and the actual speed data $D_V$ of the elevator (corresponding to $V_l$ in FIG. 10) at the point Q are read out, and the difference $D_M - D_V$ is compared with the allowable minimum speed drop $D_\alpha$ stored in the ROM 27. If $D_M - D_V \geqq D_\alpha$, it is determined that the elevator has been decelerated normally, and if $D_M - D_V < D_\alpha$, it is determined that the elevator has not sufficiently been decelerated. Thus, the abnormal condition is determined and the process goes to the step 900 to stop the elevator.

According to the above process, the elevator can be stopped at a position where the elevator is still operative to start again even if the elevator fails to normally decelerate to stop at the terminal floor such as the uppermost or lowermost floor. As a result, the abnormal speed checking pattern may be prepared with a large margin relative to the reference elevator speed so that the abnormal speed check is reliably carried out irrespective of the variances of the motor characteristic, the elevator controller characteristic or the detection characteristic of the deceleration initiating position detector.

As described hereinabove, according to the abnormal speed detector of the present invention, the actual speed of the elevator and the abnormal speed checking data stored in the memory are sequentially compared to check if the elevator speed is normal or not in order to detect the abnormal speed of the elevator. Accordingly, if the elevator fails resulting in that the elevator speed abnormally increases or decreases, it is rapidly detected to stop the elevator.

What is claimed is:

1. An abnormal speed detector for an elevator system having an elevator car for servicing a plurality of floors, drive means for driving said elevator car at various speeds in a pattern according to a predetermined speed command and speed detector means for detecting the running speed of said elevator car, said abnormal speed detector comprising:

storage means for storing a set of speed data representing a predetermined abnormal speed pattern as a function of at least one parameter whose value unidirectionally changes after the elevator car starts to run, said abnormal speed pattern including data relating to an abnormality of the elevator speed for all speeds from start to stop thereof;

means for periodically reading out of said storage means speed data corresponding to a current value of said one unidirectionally changing parameter from said set of speed data in accordance with changes in said parameter value after the start of the run of said elevator car; and means for comparing the actual speed of said elevator car as provided by said speed detector means with the speed data read out of said storage means to determine if the speed of said elevator car is normal or not.

2. An abnormal speed detector according to claim 1 wherein the parameter used at least during deceleration is the distance which said elevator car has run after initiation of deceleration.

3. An abnormal speed detector according to claim 1 wherein the parameter used before deceleration is the elapsed time interval after the start of run of said elevator car, while the parameter used during deceleration is the distance which said elevator car has run after initiation of deceleration.

4. An abnormal speed detector according to claim 1 wherein said abnormal speed pattern stored in said storage means includes a set of data from which an upper limit speed pattern and a lower limit speed pattern may be derived, said comparing means including means for detecting an abnormal condition when the speed of said elevator car is higher than said upper limit speed pattern data or lower than said lower limit speed pattern data.

5. An abnormal speed detector according to claim 1 wherein said abnormal speed pattern has a constant level between the start of run of said elevator car and the initiation of deceleration thereof and a variable level decending from said constant level as a function of run distance of said elevator car measured from the initiation of deceleration between the initiation of deceleration and the stop of said elevator car.

6. An abnormal speed detector according to claim 1 wherein said abnormal speed checking pattern rises as a function of a time elapsed after the start of the run of said elevator car during an acceleration period and falls as a function of a run distance of said elevator car measured from the initiation of deceleration during a deceleration period.

7. An abnormal speed detector according to claim 1 further comprising:

means for detecting the maximum speed of said elevator car after the start of run of said elevator car and for storing said maximum speed, means for detecting the difference between the actual speed of said elevator car detected when said elevator car has run a predetermined distance after the initiation of deceleration to stop at a terminal floor and said maximum speed, and means for comparing an output of said speed difference detecting means with a predetermined value to detect a abnormal condition when said output of said speed difference detecting means is lower than said predetermined value.

8. An abnormal speed detector for an elevator system having an elevator car for servicing a plurality of floors, means for driving said elevator car so as to follow a speed command and speed detector means for detecting the running speed of said elevator car, comprising:

means for detecting the maximum speed of said elevator car after the elevator car starts to run from a standstill condition and for storing said maximum speed;

means for detecting that said elevator car has reached a predetermined position after initiation of deceleration to stop at a terminal floor; and means for detecting the difference between the actual speed of said elevator car when said elevator car has reached said predetermined position and said maximum speed to detect an abnormal condition when said speed difference is smaller than a predetermined value.

* * * * *